US009109323B2

(12) United States Patent
Yoon

(10) Patent No.: US 9,109,323 B2
(45) Date of Patent: Aug. 18, 2015

(54) WASHING MACHINE

(75) Inventor: Hyoung Tae Yoon, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 138 days.

(21) Appl. No.: 13/976,477

(22) PCT Filed: Dec. 27, 2011

(86) PCT No.: PCT/KR2011/010177

§ 371 (c)(1),
(2), (4) Date: Jun. 27, 2013

(87) PCT Pub. No.: WO2012/091423

PCT Pub. Date: Jul. 5, 2012

(65) Prior Publication Data

US 2013/0269397 A1 Oct. 17, 2013

(30) Foreign Application Priority Data

Dec. 27, 2010 (KR) ..... 10-2010-0135374

(51) Int. Cl.

| | |
|---|---|
| ***D06F 21/00*** | (2006.01) |
| ***D06F 37/30*** | (2006.01) |
| ***D06F 39/08*** | (2006.01) |
| ***D06F 37/40*** | (2006.01) |

(52) U.S. Cl.

CPC ..... *D06F 37/30* (2013.01); *D06F 37/40* (2013.01); *D06F 39/083* (2013.01)

(58) Field of Classification Search

CPC ..... D06F 37/40; D06F 37/304; D06F 37/206; D06F 37/30; D06F 23/04

USPC ..... 68/140, 12.24, 24, 208, 133, 23.7, 68/12.02, 3 R, 12.14, 12.16; 8/159, 137; 134/186, 10, 111, 18

See application file for complete search history.

(56) References Cited

U.S. PATENT DOCUMENTS

| | | | | |
|---|---|---|---|---|
| 5,152,159 | A * | 10/1992 | Kabeya et al. | 68/12.02 |
| 2003/0034054 | A1 * | 2/2003 | Lee et al. | 134/22.18 |

FOREIGN PATENT DOCUMENTS

| | | | |
|---|---|---|---|
| KR | 20-1993-0008272 | Y1 | 12/1993 |
| KR | 20-0122427 | Y1 | 10/1998 |
| KR | 20-0124974 | Y1 | 12/1998 |
| KR | 10-2003-0080760 | A | 10/2003 |

OTHER PUBLICATIONS

International Search Report; PCT/KR2011/010177; Int'l File Date: Dec. 27, 2011; Daewoo Electronics Corporation; 2 pgs.

* cited by examiner

*Primary Examiner* — Michael Barr
*Assistant Examiner* — Thomas Bucci

(57) ABSTRACT

A washing machine includes: a synchronous motor unit installed at the bottom of a tub; a drain valve housing installed at the bottom of the tub; a link unit disposed between the synchronous motor unit and the drain valve housing; a wire unit having one side connected to the synchronous motor unit and the other side connected to the link unit; a spring member having one side connected to the link unit and the other side connected to the drain valve housing; a clutch lever unit rotatably installed on a clutch base unit and rotated in connected with the movement of the link unit caused by the operation of the synchronous motor unit; a cam lever unit connected to the clutch lever unit; a lift lever unit contacted with the cam lever unit; and a coupling unit engaged with a rotor unit or clutch body unit.

6 Claims, 6 Drawing Sheets

WASHING MACHINE

FIELD OF TECHNOLOGY

The present invention relates to a washing machine, and more particularly, to a washing machine which is capable of performing a drain process and a clutch operation at the same time, using one synchronous motor unit.

BACKGROUND

In general, a washing machine refers to a product that removes pollutants of clothes and bedclothes through emulsification of a detergent and friction and impact of water flow, caused by rotations of a pulsator.

The washing machine senses the amount and type of laundry through a sensor so as to automatically set a washing method, supplies water up to a proper level according to the amount and type of the laundry, and then performs washing according to control of a microprocessor.

The washing machine includes a tub mounted in a cabinet forming the exterior of thereof and storing washing water, and a washing tub having a plurality of spin-drying holes is rotatably installed in the tub.

The washing tub has a pulsator rotatably installed in the center of the bottom thereof, and the tub has a driving device installed at the bottom thereof, the driving device including a clutch and motor to rotate the washing tub and the pulsator.

The above-described configuration is a related art for helping an understanding of the present invention, and does not mean a related art which is widely known in the technical field to which the present invention pertains.

The conventional washing machine includes a drain synchronous motor for a drain process and a clutch motor to operate a clutch. Therefore, since the structure becomes complex, the manufacturing cost increases.

Therefore, there is a demand for a structure for reducing the manufacturing cost.

SUMMARY

The present invention is conceived to solve such problems of the related art, and an aspect of the invention is to provide a washing machine capable of performing a drain process and a clutch operation at the same time, using one synchronous motor unit.

Technical Solution

According to an aspect of the invention, a washing machine includes: a synchronous motor unit installed at the bottom of a tub; a drain valve housing installed at the bottom of the tub so as to be spaced from the synchronous motor unit; a link unit disposed between the synchronous motor unit and the drain valve housing, and opening and closing the drain valve housing; a wire unit having one side connected to the synchronous motor unit and the other side connected to the link unit, and moving the link unit according to operation of the synchronous motor unit; a spring member having one side connected to the link unit and the other side connected to the drain valve housing, and providing a restoring force such that the link unit closes the drain valve housing; a clutch lever unit rotatably installed on a clutch base unit, disposed between the link unit and the synchronous motor unit, and rotated in connected with the movement of the link unit caused by the operation of the synchronous motor unit; a cam lever unit connected to the clutch lever unit; a lift lever unit contacted with the cam lever unit; and a coupling unit moved by the lift lever unit and engaged with a rotor unit or clutch body unit.

During an on mode of the synchronous motor unit, the wire unit may be wound around the synchronous motor unit, the link unit may be moved toward the synchronous motor unit to open the drain valve housing, and the clutch lever unit may be pressurized by the link unit and moved toward the synchronous motor unit.

During an off mode of the synchronous motor unit, the wire unit wound around the synchronous motor unit may be unwound, the link unit may be moved toward the drain valve housing by a restoring force of the spring member so as to close the drain valve housing, and the pressurization by the link unit may be released to return the clutch lever unit to the original position.

The clutch lever unit may include a through-groove through which the wire unit passes, such that the wire unit does not rotate the clutch lever unit when wound or unwound.

The through-groove may include a vertical portion formed upward from the bottom surface of the clutch lever unit and a horizontal portion extended horizontally from the top of the vertical portion, and the wire unit may be introduced through the vertical portion and received in the horizontal portion.

The through-groove may be formed in an L-shape.

The cam lever unit may have an inclined surface formed at a portion contacted with the lift lever portion.

When the lift lever unit and the cam lever unit are contacted with each other at one side of the inclined surface, the coupling unit and the rotor unit may be engaged with each other by the lift lever unit.

When the lift lever unit and the cam lever unit are contacted with each other at the other side of the inclined surface, the coupling unit and the clutch body unit may be engaged with each other by the lift lever unit.

Advantageous Effects

In accordance with the embodiment of the present invention, since the drain process and the clutch operation may be performed at the same time by one synchronous motor unit, the structure may be simplified to thereby reduce a manufacturing cost.

Furthermore, since the drain process and the clutch operation may be performed at the same time by one synchronous motor unit, power consumption may be reduced.

Furthermore, since the operation of the synchronous motor unit may be switched to the opening/closing operation of the drain valve housing and the rotating operation of the clutch lever unit by the wire unit connecting the synchronous motor unit and the link unit, the power transmission device may be simplified. Accordingly, the product may be reduced in size, and the manufacturing cost may be reduced.

Furthermore, since the operation of the synchronous motor unit is transmitted to the link unit through the wire unit, a loss occurring during the power transmission process may be reduced. Accordingly, the energy efficiency of the washing machine may be improved, and the same energy efficiency may be obtained even though a low-capacity synchronous motor unit is used.

Furthermore, since the movement of the link unit may be controlled only by an amount of the wire unit wound and unwound around the synchronous motor unit, the movement of the link unit may be controlled more precisely.

BRIEF DESCRIPTION

The above and other aspects, features and advantages of the invention will become apparent from the following detailed description in conjunction with the accompanying drawings, in which.

DETAILED DESCRIPTION

Embodiments of the invention will hereinafter be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
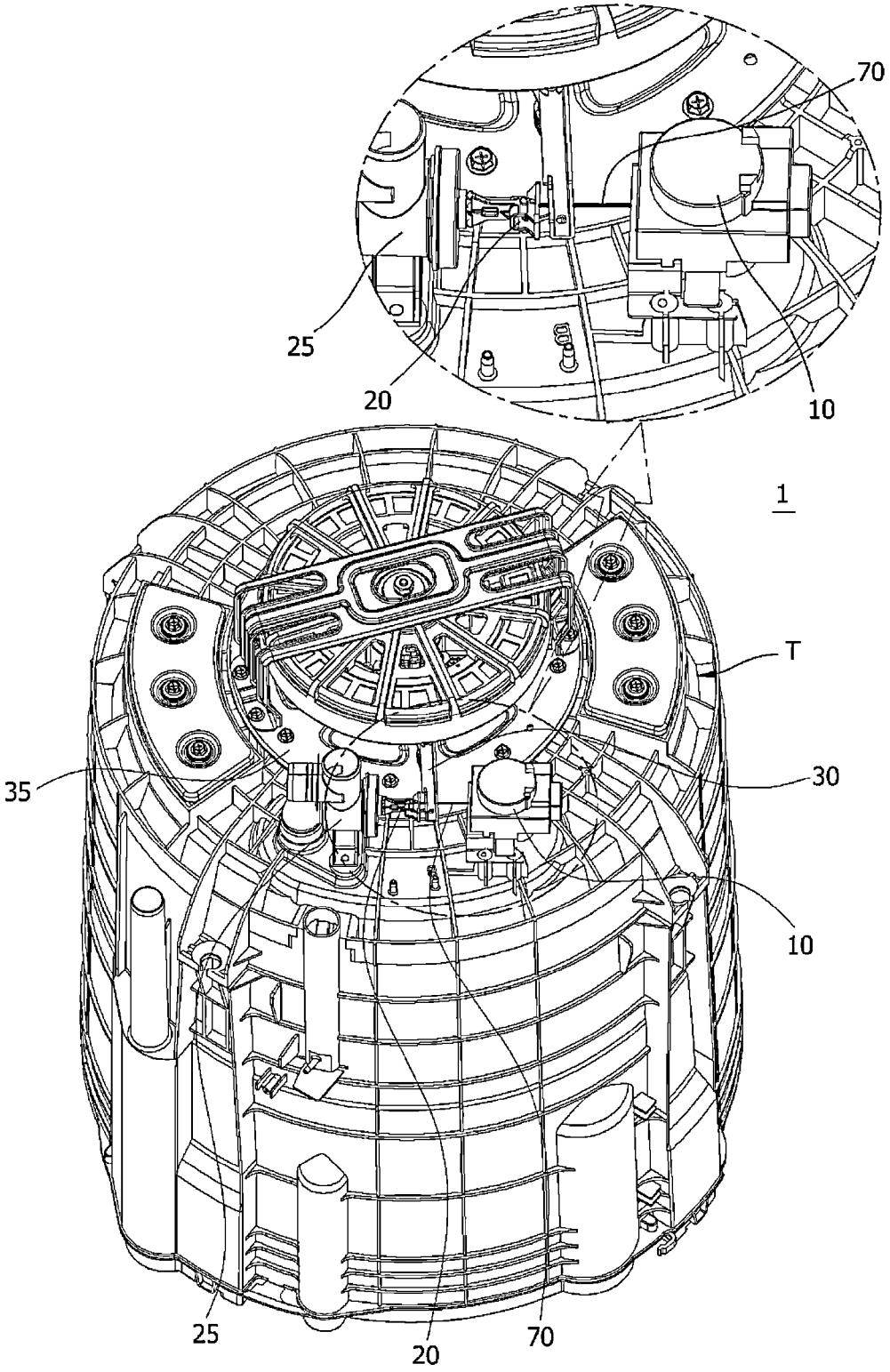
FIG. 1 is a diagram illustrating a washing process state of a washing machine in accordance with an embodiment of the present invention.
Figure 2:
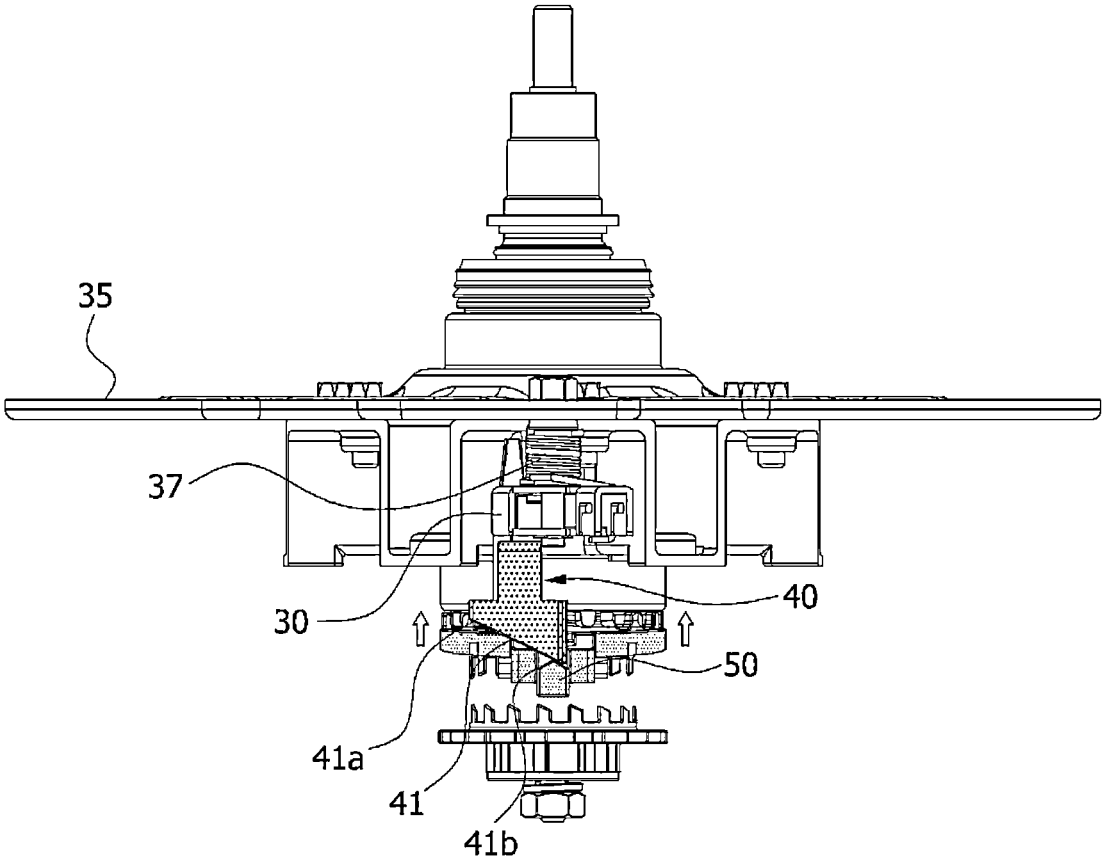
FIG. 2 is a first side view illustrating the washing process state of the washing machine in accordance with the embodiment of the present invention.
Figure 3:
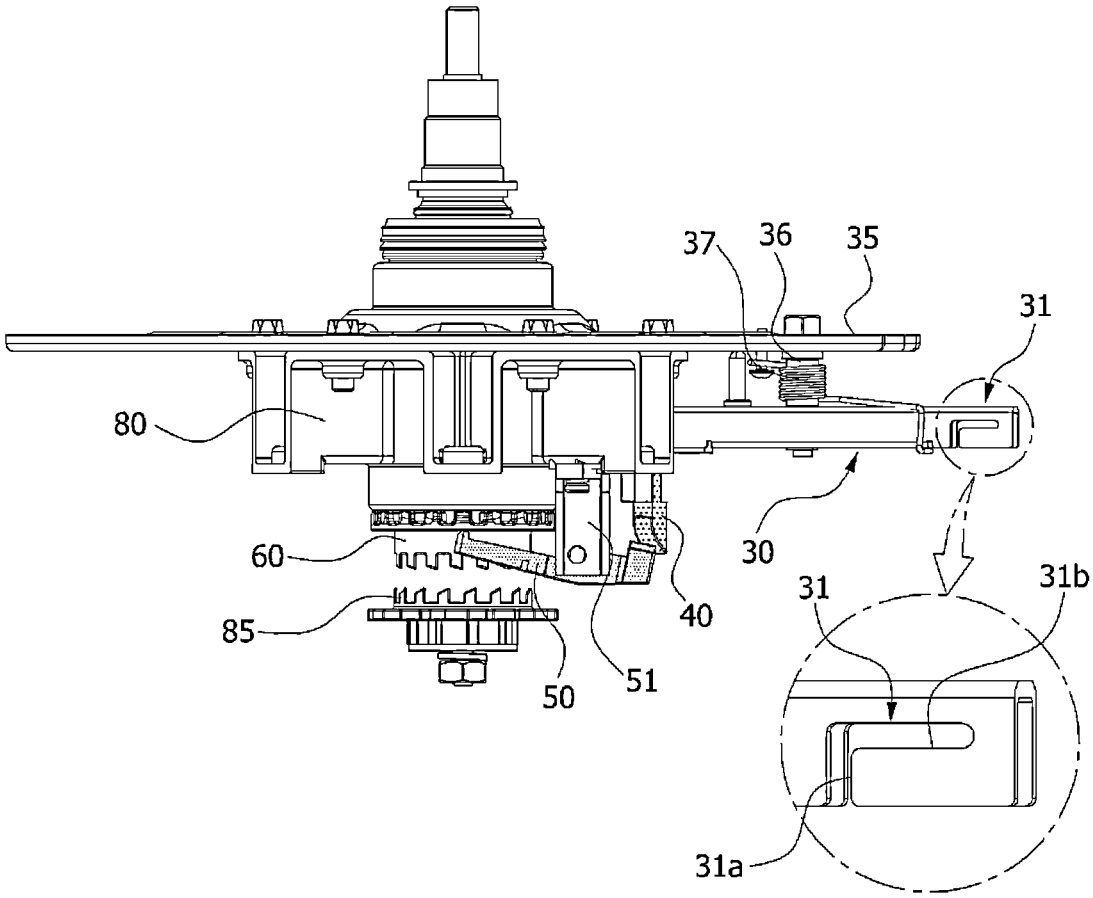
FIG. 3 is a second side view illustrating the washing process state of the washing machine in accordance with the embodiment of the present invention.
Figure 4:
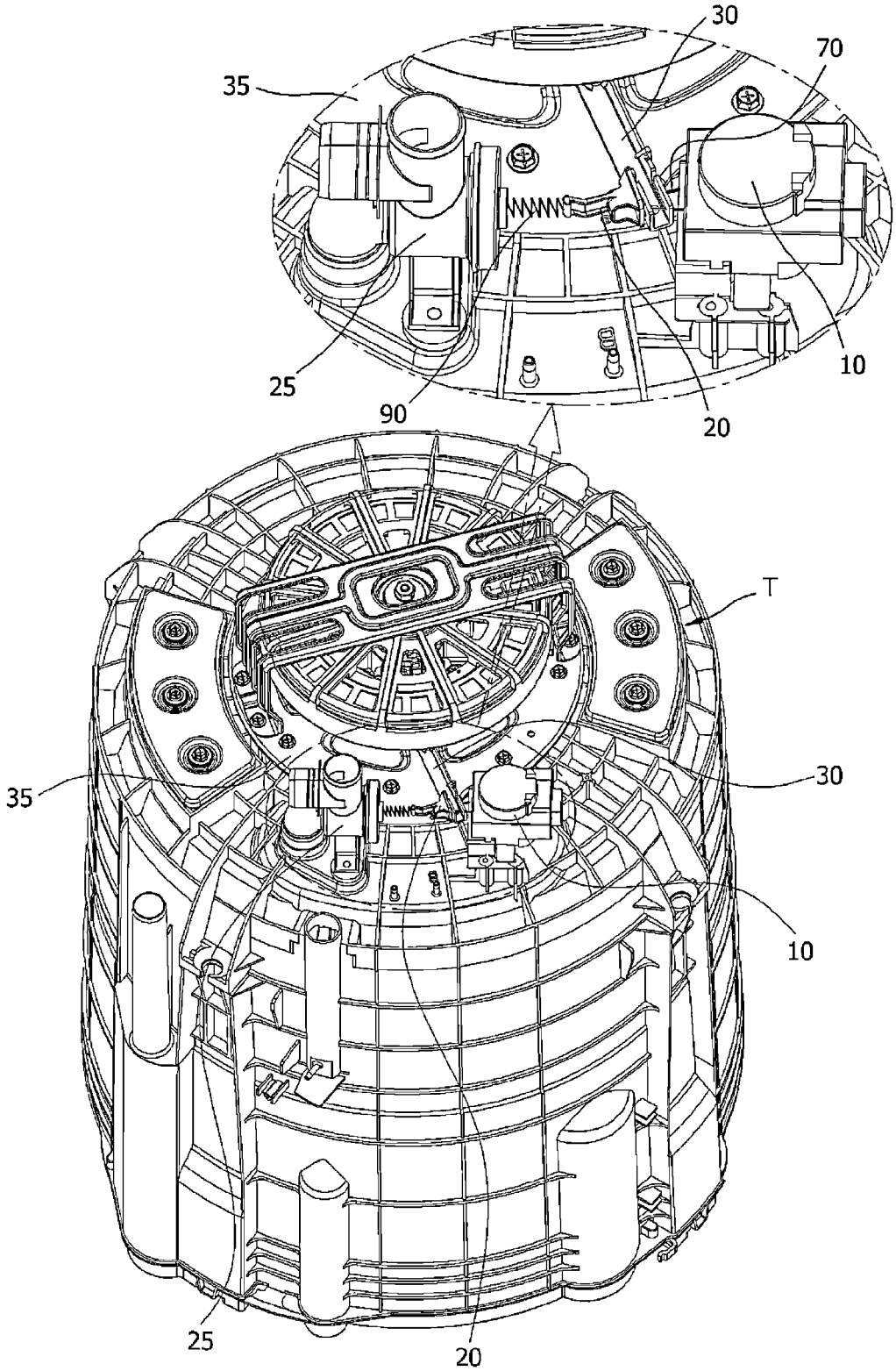
FIG. 4 is a diagram illustrating a spin-drying process state of the washing machine in accordance with the embodiment of the present invention.
Figure 5:
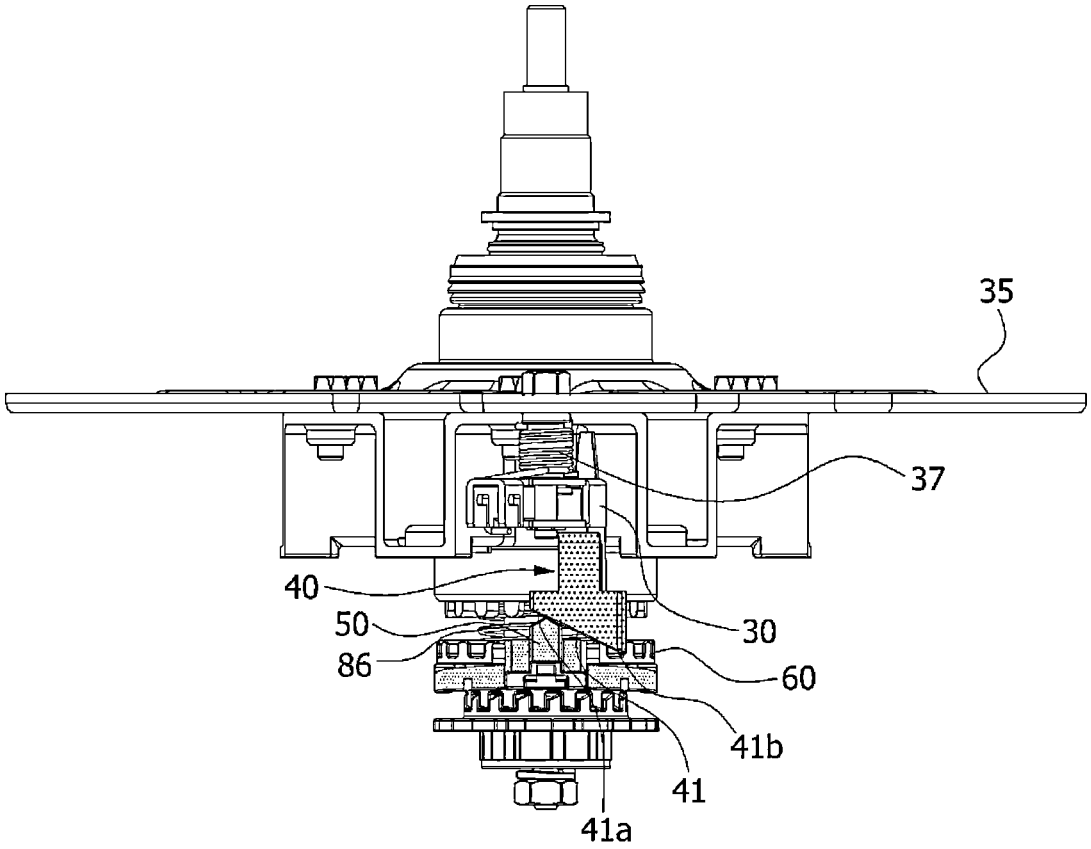
FIG. 5 is a first side view illustrating the spin-drying process state of the washing machine in accordance with the embodiment of the present invention.
Figure 6:
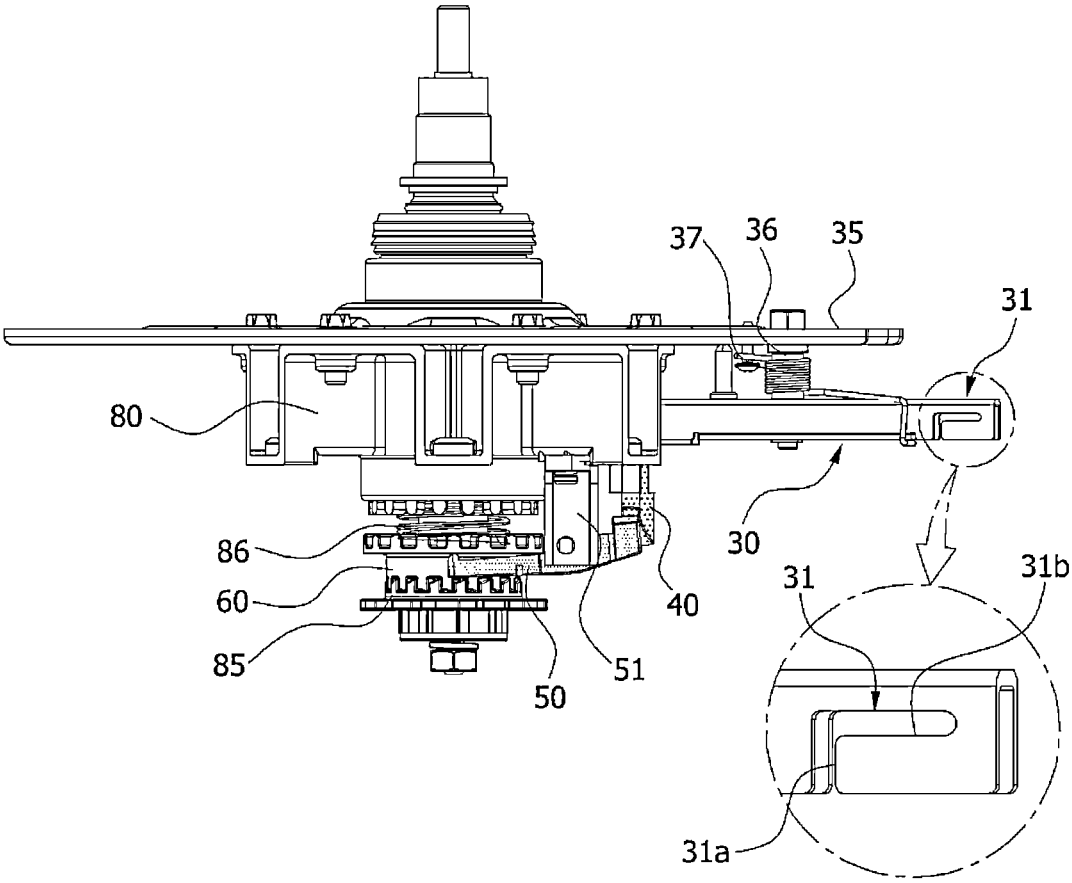
FIG. 6 is a second side view illustrating the spin-drying process state of the washing machine in accordance with the embodiment of the present invention.

FIG. 1 is a diagram illustrating a washing process state of a washing machine in accordance with an embodiment of the present invention. FIG. 2 is a first side view illustrating the washing process state of the washing machine in accordance with the embodiment of the present invention. FIG. 3 is a second side view illustrating the washing process state of the washing machine in accordance with the embodiment of the present invention. FIG. 4 is a diagram illustrating a spin-drying process state of the washing machine in accordance with the embodiment of the present invention. FIG. 5 is a first side view illustrating the spin-drying process state of the washing machine in accordance with the embodiment of the present invention. FIG. 6 is a second side view illustrating the spin-drying process state of the washing machine in accordance with the embodiment of the present invention.

Referring to FIGS. 1 to 6, the washing machine 1 in accordance with the embodiment of the present invention includes a synchronous motor unit 10, a link unit 20, a drain valve housing 25, a clutch lever unit 30, a cam lever unit 40, a lift lever unit 50, a coupling unit 60, a wire unit 70, a clutch body unit 80, and a spring member 90.

Referring to FIG. 1, the synchronous motor unit 10 is installed at the bottom of a tub T. The synchronous motor unit 10 is connected to the link unit 20 through the wire unit 70. According to an on/off mode of the synchronous motor unit 10, the length of the wire unit 70 is changed while the wire unit 70 is wound or unwound around the synchronous motor unit 10.

That is, the wire unit 70 has one side connected to the synchronous motor unit 10 and the other side connected to the link unit 20, and moves the link unit 20 according to operation of the synchronous motor unit 10. The movement of the link unit 20 is performed while the length of the wire unit 70 wound or unwound around the synchronous motor unit 10 is changed.

In accordance with the embodiment of the present invention, during the on mode of the synchronous motor unit 10 (refer to FIGS. 4 to 6), the length of the wire unit 70 is decreased while the wire unit 70 is wound around the synchronous motor unit 10, and during the off mode of the synchronous motor unit 10 (refer to FIGS. 1 to 3), the length of the wire unit 70 is restored to the original state while the wire unit 70 is unwound.

In the washing machine 1, the on mode of the synchronous motor unit 10 is performed during a spin-drying process of the washing machine, and the off mode of the synchronous motor unit 10 is performed during a washing process of the washing machine.

The drain valve housing 25 is installed at the bottom of the tub T so as to be spaced from the synchronous motor unit 10.

The link unit 20 is disposed between the synchronous motor unit 10 and the drain valve housing 25. The link unit 20 is moved in a horizontal direction according to the on/off mode of the synchronous motor unit 10, and then opens or closes the drain valve housing 25.

The link unit 20 is connected to the synchronous motor unit 10 by the wire unit 70. Therefore, when the length of the wire unit 70 is changed by the operation of the synchronous motor unit 10, the link 20 is moved in a horizontal direction so as to open or close the drain valve housing 25.

During the on mode of the synchronous motor unit 10, the length of the wire unit 70 is decreased while the wire unit 70 is wound around the synchronous motor unit 10 (FIG. 4). Accordingly, the link unit 20 is moved toward the synchronous motor unit 10 so as to open the drain valve housing 25. Then, the drain process is performed.

On the other hand, during the off mode of the synchronous motor unit 10, the length of the wire unit 70 is restored to the original state, while the wire unit 70 having been wound around the synchronous motor unit 10 is unwound (FIG. 1). At this time, the link unit 20 is moved toward the drain valve housing 25 by a restoring force of the spring member 90 so as to close the drain valve housing 25. Then, the drain process is ended.

The spring member 90 has one side connected to the link unit 20 and the other side connected to the drain valve housing 25. Therefore, when an external force to move the link unit 20 toward the synchronous motor unit 10 is removed as in the off mode of the synchronous motor unit 10, the link unit 20 is returned to the original position by the restoring force of the spring member 90 (FIG. 1). The link unit 20 returned to the original position closes the drain valve housing 25.

The clutch lever unit 30 is rotatably installed on a clutch base unit 35. In accordance with the embodiment of the present invention, the clutch lever unit 30 is coupled to the clutch base unit 35 by a shaft member 36, and rotated about the shaft member 36 serving as the axis of rotation.

The shaft member 36 has an elastic member 37 mounted thereon and providing a restoring force to return the clutch lever unit 30 to the original position during the off mode of the synchronous motor unit 10.

The clutch lever unit 30 is rotated in connection with the movement of the link unit 20. The clutch lever unit 30 is disposed between the synchronous motor unit 10 and the link unit 20. Therefore, when the link unit 20 is moved in a horizontal direction, the clutch lever unit 30 is rotated in the clockwise or counterclockwise direction while the clutch lever unit 30 is pressurized by the link unit 20 or the pressurization is released.

During the on mode of the synchronous motor unit 10, the link unit 20 pressurizes the clutch lever unit 30 while moved toward the synchronous motor unit 10 (FIG. 4). At this time, the clutch lever unit 30 is rotated about the shaft member 36 serving as the axis of rotation.

On the other hand, during the off mode of the synchronous motor unit 10, the link unit 20 is restored to the original position. Therefore, the pressurizing force having been applied to the clutch lever unit 30 disappears (FIG. 1). Therefore, the clutch lever unit 30 is returned to the original position by the elastic member 37.

The clutch lever unit 30 includes a through-groove 31 through which the wire unit 70 passes. Since the wire unit 70 is horizontally moved through the through-groove 31, the rotation of the clutch lever unit 30 is not performed even while the wire unit 70 is wound or unwound. That is, the rotation of the clutch lever unit 30 is not performed by the movement of the wire unit 70, but performed by the horizontal movement of the link unit 20.

As the through-groove 31 is formed in the clutch lever unit 30, the clutch lever unit 30 does not interfere with the wire unit 70 when the wire unit 70 is wound or unwound.

The through-groove 31 includes a vertical portion 31 a formed upward from the bottom surface of the clutch lever unit 30 and a horizontal portion 31*b* extended horizontally from the top of the vertical portion 31*a*.

The wire unit 70 is introduced through the vertical portion 31*a* and received in the horizontal portion 31*b*. Accordingly, as the wire unit 70 is supported by the horizontal portion 31*b*, the wire unit 70 is prevented from sagging downward. In accordance with the embodiment of the present invention, the through-clutch groove 31 is formed in an L-shape.

The cam lever unit 40 is connected to the clutch lever unit 30. In accordance with the embodiment of the present invention, the clutch lever unit 30 is coupled to the cam lever unit 40 in the opposite side of the portion contacted with the link unit 20.

The cam lever unit 40 has an inclined surface 41. The cam lever unit 40 is coupled to the clutch lever unit 30 at the top thereof (based on FIG. 2), and the inclined surface 41 is provided at the bottom of the cam lever unit 40. The inclined surface 41 is formed in such a manner that a distance from the clutch base unit 35 gradually increases from one side to the other side thereof.

The lift lever unit 50 is contacted with the cam lever unit 40 at the inclined surface 41. In accordance with the embodiment of the present invention, the lift lever unit 50 is connected to the clutch body unit 80 through a lift bracket 51. The lift lever unit 50 is rotatably mounted on the lift bracket 51.

The coupling unit 60 is moved upward or downward by the lift lever unit 50 and engaged with the clutch body unit 80 or a rotor unit 85.

Since the cam lever unit 40 is connected to the clutch lever unit 30, the cam lever unit 40 is rotated in the same direction by the rotation of the clutch lever unit 30.

During the on mode of the synchronous motor unit 10, the cam lever unit 40 is rotated by the rotation of the clutch lever unit 30, and contacted with the lift lever unit 50 at one side 41*a* of the inclined surface 41.

The one side 41*a* of the inclined surface 41 is closer to the clutch base unit 35 than the other side 41*b* thereof. Therefore, as one end of the lift lever unit 50 (right end in FIG. 6) contacted with the inclined surface 41 is positioned at a relatively high level, the other end (left end) of the lift lever unit 50 coupled to the coupling unit 60 is positioned at a relatively low level according to the principle of a lever, thereby engaging the coupling 60 with the rotor unit 85. As the coupling unit 60 and the rotor unit 85 are engaged with each other, the washing machine may perform a drain process.

On the other hand, during the off mode of the synchronous motor unit 10, the cam lever unit 40 is contacted with the lift lever unit 50 at the other side 41*b* of the inclined surface 41, while the clutch lever unit 30 and the cam lever unit 40 are rotated in reverse directions. The other side 41*b* of the inclined surface 41 is further spaced from the clutch base unit 35 than the one side 41*a* thereof. Therefore, as the one end of the lift lever unit 50 (right end in FIG. 3) contacted with the inclined surface 41 is positioned at a relatively low level, the other end (left end) of the lift lever unit 50 coupled to the coupling unit 60 is positioned at a relatively high level according to the principle of a lever, thereby engaging the coupling unit 60 with the clutch body unit 80. As the coupling unit 60 and the clutch body unit 80 are engaged with each other, the washing machine may perform the washing process.

A spring 86 is disposed between the clutch body unit 80 and the coupling unit 60. The spring 86 elastically supports the coupling unit 60 in a direction where the coupling unit 60 is spaced from the clutch body unit 80, that is, directed toward the rotor unit 85.

Hereinafter, the operation principle of the washing machine in accordance with the embodiment of the present invention will be described.

During the off mode of the synchronous motor unit 10, the drain valve housing 25 is closed, and the coupling unit 60 is engaged with the clutch body unit 80. Therefore, when power is supplied to the washing machine 1, a washing process is performed, and washing water existing in the tub is not drained to the outside.

When a spin-drying process is to be performed, the synchronous motor unit 10 is switched to the on mode. During the on mode of the synchronous motor unit 10, the link unit 20 is moved toward the synchronous motor unit 10 while the length of the wire unit 70 is decreased. Accordingly, the drain valve housing 25 is opened to perform a drain process. Simultaneously, the clutch lever unit 30 is rotated toward the synchronous motor unit 10 by the movement of the link unit 20. At this time, as the cam lever unit 40, the lift lever unit 50, and the coupling unit 60 connected to the clutch lever unit 30 are sequentially moved, the coupling 60 is engaged with the rotor unit 85.

Therefore, the washing machine may perform the drain process and the spin-drying process at the same time, and the two processes may be performed through the operation of one synchronous motor unit 10. Similarly, when the synchronous motor unit 10 is switched to the off mode, the washing process may be performed, and the drain process may be stopped.

Although some embodiments have been provided to illustrate the invention in conjunction with the drawings, it will be apparent to those skilled in the art that the embodiments are given by way of illustration only, and that various modifications and equivalent embodiments can be made without departing from the spirit and scope of the invention. The scope of the invention should be limited only by the accompanying claims.

The invention claimed is:

1. A washing machine comprising:

a synchronous motor unit installed at the bottom of a tub;

a drain valve housing installed at the bottom of the tub so as to be spaced from the synchronous motor unit;

a link unit disposed between the synchronous motor unit and the drain valve housing, and opening and closing the drain valve housing;

a wire unit having one side connected to the synchronous motor unit and the other side connected to the link unit, and moving the link unit according to operation of the synchronous motor unit;

a spring member having one side connected to the link unit and the other side connected to the drain valve housing, and providing a restoring force such that the link unit closes the drain valve housing;

a clutch lever unit rotatably installed on a clutch base unit, disposed between the link unit and the synchronous motor unit, and rotated in connected with the movement of the link unit caused by the operation of the synchronous motor unit;

a cam lever unit connected to the clutch lever unit;

a lift lever unit contacted with the cam lever unit; and a coupling unit moved by the lift lever unit and engaged with a rotor unit or clutch body unit, wherein during an on mode of the synchronous motor unit, the wire unit is wound around the synchronous motor unit, the link unit is moved toward the synchronous motor unit to open the drain valve housing, and the clutch lever unit is pressurized by the link unit and moved toward the synchronous motor unit, wherein during an off mode of the synchronous motor unit, the wire unit wound around the synchronous motor unit is unwound, the link unit is moved toward the drain valve housing by a restoring force of the spring member so as to close the drain valve housing, and the pressurization by the link unit is released to return the clutch lever unit to the original position, and wherein the clutch lever unit comprises a through-groove through which the wire unit passes, such that the wire unit does not rotate the clutch lever unit when wound or unwound.

2. The washing machine according to claim 1, wherein the through-groove comprises a vertical portion formed upward from the bottom surface of the clutch lever unit and a horizontal portion extended horizontally from the top of the vertical portion, and the wire unit is introduced through the vertical portion and received in the horizontal portion.

3. The washing machine according to claim 2, wherein the through-groove is formed in an L-shape.

4. The washing machine according to claim 2, wherein the cam lever unit has an inclined surface formed at a portion contacted with the lift lever portion.

5. The washing machine according to claim 4, wherein when the lift lever unit and the cam lever unit are contacted with each other at one side of the inclined surface, the coupling unit and the rotor unit are engaged with each by the lift lever unit.

6. The washing machine according to claim 5, wherein when the lift lever unit and the cam lever unit are contacted with each other at the other side of the inclined surface, the coupling unit and the clutch body unit are engaged with each other by the lift lever unit.

* * * * *